US009132945B1

(12) United States Patent
Midboe

(10) Patent No.: US 9,132,945 B1
(45) Date of Patent: Sep. 15, 2015

(54) PUSH BUTTON LOCK

(71) Applicant: Brandon Ray Midboe, Goodyear, AZ (US)

(72) Inventor: Brandon Ray Midboe, Goodyear, AZ (US)

( * ) Notice: Subject to any disclaimer, the term of this patent is extended or adjusted under 35 U.S.C. 154(b) by 0 days.

(21) Appl. No.: 14/340,538

(22) Filed: Jul. 24, 2014

Related U.S. Application Data

(60) Provisional application No. 61/858,098, filed on Jul. 24, 2013.

(51) Int. Cl.
*B65D 50/02* (2006.01)
*E05B 37/00* (2006.01)

(52) U.S. Cl.
CPC ..... *B65D 50/02* (2013.01); *E05B 37/0048* (2013.01); *E05B 37/0072* (2013.01)

(58) Field of Classification Search
CPC ..... E05B 65/52; E05B 37/00; E05B 37/0048; E05B 37/0072; E05B 37/0044; E05B 37/0062; B65D 41/06; B65D 41/04; B65D 45/16; B65D 45/02; B65D 50/061; B65D 50/06; B65D 50/02; B65D 50/041
USPC ..... 70/286, 287, 288, 291, 297, 298, 299, 70/300, 320, 321, 322, 323, 327, 63, 57, 70/58; 220/296, 300, 293, 324, 315, 212, 220/284; 215/206, 216, 228
See application file for complete search history.

(56) References Cited

U.S. PATENT DOCUMENTS

| | | | | | |
|---|---|---|---|---|---|
| 690,191 | A * | 12/1901 | Saxe | 70/352 |
| 1,403,328 | A * | 1/1922 | Keplinger | 70/306 |
| 2,173,680 | A * | 9/1939 | Curran | 70/299 |
| 4,014,194 | A * | 3/1977 | Hartman | 70/313 |
| 4,782,963 | A * | 11/1988 | Hunter | 215/206 |
| 5,189,894 | A * | 3/1993 | Buck | 70/63 |
| 5,212,971 | A * | 5/1993 | Yoon et al. | 70/165 |
| 5,697,239 | A * | 12/1997 | Hanneman et al. | 70/493 |
| 7,966,850 | B2 * | 6/2011 | Chapnik | 70/57.1 |
| 8,875,915 | B2 * | 11/2014 | Serell | 215/206 |
| 2004/0195241 | A1 * | 10/2004 | Stull et al. | 220/326 |
| 2010/0147867 | A1 * | 6/2010 | Villegas Estrada | 221/87 |
| 2011/0132049 | A1 * | 6/2011 | Meekma et al. | 70/314 |

* cited by examiner

*Primary Examiner* — Lloyd Gall
*Assistant Examiner* — Amanda L Miller
(74) *Attorney, Agent, or Firm* — Shane V. Cortesi

(57) ABSTRACT

The present invention relates to a combination lock. The lock is particularly adapted for locking a container such as a pill bottle and includes a push button lid with a plurality of push button tabs. The tabs include indicia and a plurality of protrusions that mate with recesses located, for example, on a container or a receiver tube. In some embodiments, some of the recesses include a ramp that is configured to move a protrusion laterally when the protrusion moves along the ramp so that the lid can be lifted off of the container.

30 Claims, 10 Drawing Sheets

PUSH BUTTON LOCK

RELATED APPLICATIONS

This application claims priority under 35 U.S.C. §119 to U.S. Provisional Application No. 61/858,098, filed Jul. 24, 2013, the entire contents of which are incorporated by reference herein.

BACKGROUND

1. Technical Field

The present invention relates to a push-button combination lock.

2. Background of the Invention

In the US and around the world, many prescription drugs such as pain killers (e.g., oxycodone and hydromorphone) and stimulants (such as amphetamine and dextroamphetamine) are susceptible to misuse. In some cases, the misuse relates to people other than the prescription holder trying to take the drugs. In other cases, the misuse relates to a prescription holder trying to take more than the prescribed dose—e.g., an adolescent prescription holder trying to take the drug when an adult caretaker is not watching.

There is a continuing need to prevent abuse of prescription drugs.

BRIEF SUMMARY

The present invention relates to a lock for a container or other object. In some embodiments, the lock system includes:

A) a container comprising an interior, an exterior, a bottom and a top;

B) a lock located at the top of the container, the lock configured to removably close the top of the container, the lock comprising:

i) a push button lid comprising a plurality of push button tabs, the tabs each having:

a) a top side, the top side comprising an interior surface facing the top of the container and an exterior surface opposite to the interior surface, at least one of the interior surface and the exterior surface comprising an indicia; and b) a side tab, the side tab extending downwardly from the top side at approximately a 90 degree angle relative to the top side, the side tab having a top portion, a bottom portion, a side tab height extending from the top portion to the bottom portion, an interior surface facing the container and an exterior surface opposite the interior surface, the side tab having a scoring line configured to allow a user to remove the bottom portion, the interior surface of the side tab comprising a plurality of protrusions, the plurality of protrusions spaced along the side tab height; and ii) a receiver tube, the receiver tube comprising a top, a bottom, a receiver tube height extending from the top to the bottom, an interior surface facing the container, an exterior surface opposite the interior surface, and a substantially hollow interior, the exterior surface comprising a plurality of recesses spaced along the receiver tube height and configured to receive the protrusions.

Optionally, at least one of recesses of the receiver tube comprises a first ramp and a recess adjacent to the first ramp and the first ramp is configured to move a protrusion of the push button tab laterally (i.e., outward) when the protrusion moves along the ramp. Optionally, a wall partially separates the first ramp from the adjacent recess. Optionally, the adjacent recess extends from the top of the receiver tube downward. Optionally, the receiver tube further comprises a top recess located directly above the ramp. Optionally, the receiver tube comprises a plurality of first ramps disposed about a circumference of the receiver tube. Optionally, the first ramps are spaced substantially evenly apart about the circumference. Optionally, the receiver tube is generally cylindrical, and the protrusions are spaced about a circumference of the receiver tube. Optionally, each side tab comprises at least three protrusions spaced along the side tab height and each protrusion comprises a base attached to the side tab and an apex extending away from the base, and each side tab comprises at least two apexes that point in opposite directions. Optionally, the lid further comprises a disk located substantially in the center of the lid and the top sides of the tabs of the push button lid are connected to the disk. Optionally, each of the plurality of the push button tabs comprises an inner edge attached to the disk, and an outer edge opposite the inner edge. Optionally, the push button tabs are configured to pivot along the inner edge. Optionally, the side tabs of the push button tabs form a perimeter. Optionally, the side tabs of the push button tabs are spaced evenly about the perimeter. Optionally, each of the plurality of push button tabs are substantially the same size and shape. Optionally, the indicia are numbers. Optionally, the indicia on each push button tab is different. Optionally the lock further includes a rotatable tube, the rotatable tube having a plurality of tab apertures, each tab aperture configured to receive a side tab. Optionally, the rotatable tube substantially surrounds the receiver tube. Optionally, the receiver tube is not rotatable relative to the container. Optionally, the lock further comprises a gasket located at the top of the rotatable tube. Optionally, the lock further comprises a second ramp, the second ramp configured to reset the lock if the wrong combination is entered.

In some embodiments, the present disclosure provides a method of opening a container that includes providing the container lock; pushing at least one push button tab; and rotating the push button lid relative to the receiver tube.

Optionally, the method further includes using the first ramp to move a protrusion of the push button tab laterally and into the adjacent recess. Optionally, the method further includes sliding the protrusion along the adjacent recess; and removing the push button lid from the container.

In other embodiments, the system does not include a separate receiver tube, but rather the features of the receiver tube are located on the top portion of the container.

DETAILED DESCRIPTION

Figure 1:
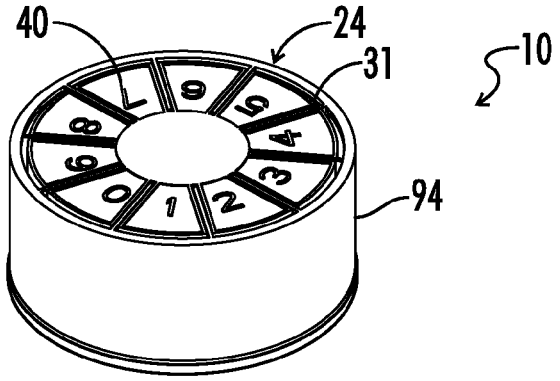
FIG. 1 illustrates a side, perspective view of a lock of one embodiment of the present invention.

Referring to FIGS. 1-16, the present disclosure provides a lock, generally designated by the numeral 10. In the drawings, not all reference numbers are included in each drawing for the sake of clarity.

In some embodiments, the lock 10 is used to removably lock a container such as a pill bottle that contains drugs.

The lock 10 may be used to lock objects other than a container. However, use of the lock 10 to removably lock a container is the preferred method of use of the lock 10.

The container or other object 16 includes an interior 12, an exterior 14, a top 18, a bottom 19 and a height 20 extending from the top 18 to the bottom 19. In some embodiments, the container 16 is comprised of plastic and prepared by, for example, injection molding.

The lock 10 is generally located at the top 18 of the container or other object 16 and is configured to removably close the top 18 of the container or other object 16. The lock 10 includes a push button lid or cap 24 that includes a plurality of push button tabs 28. The push button tabs 28 each have a top side 30 that includes an interior surface 32 facing the top 18 of the container or other object 16 and an exterior surface 34 opposite to the interior surface 32. The exterior surface 34 includes an indicia 40 (e.g., numbers or letters) that is used to generate the code for the combination lock 10. For example, in some embodiments, the lock 10 includes ten tabs 28 and the tabs 28 are numbered 0-9 and the lock's combination code consists of pushing the tabs 28 that make up the combination code (e.g., the numbers 0-1-2 if the code is 012) but not the other tabs 28 (e.g., the numbers 3-9) on the lid 24. It will be understood that the number of tabs 28, indicia 40 type and combination length are provided for illustrative purposes and that the number of tabs 28, indicia 40 type and combination length will depend on the level of security desired and the desired size of the tabs 28 (which may vary depending on the size of the container or other object 16). Optionally, the indicia 40 are provided in braille and in type face on each tab 28.

Figure 4:
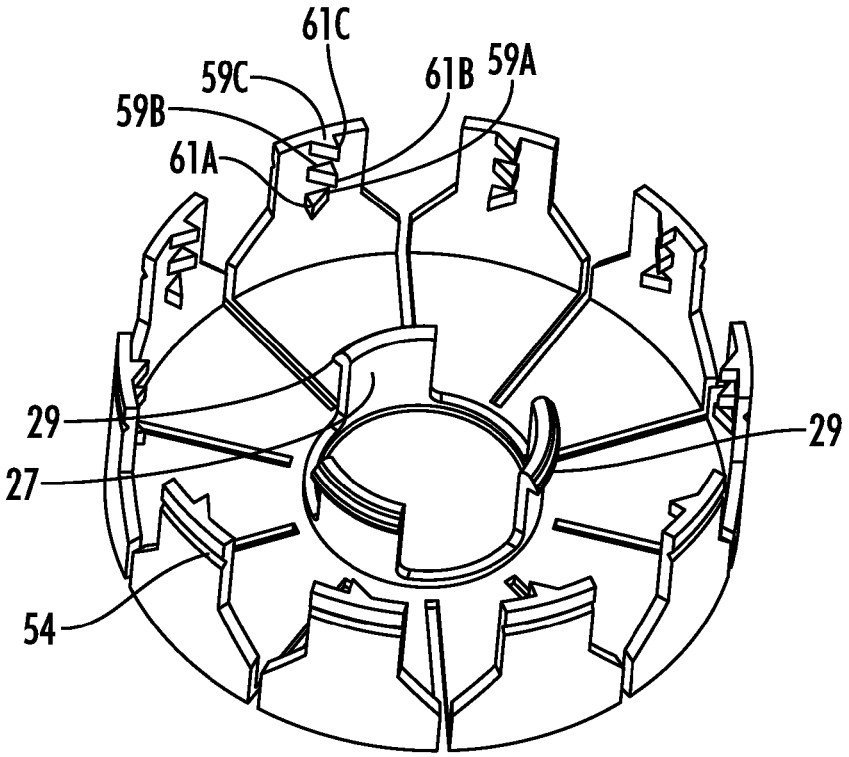
FIG. 4 illustrates a bottom, perspective view of a lid of one embodiment of the present invention.

In some embodiments, the top sides 30 of the tabs 28 are generally in the shape of a triangle or frustum (i.e., a triangle with the apex cut off by a plane parallel to the base) and the top sides 30 of all tabs 28 are substantially the same size as each other. A gap 31 is present between adjacent tabs 28. In some embodiments, each top side 30 is connected to a disk 26 of the lid 24 and the disk 26 is located substantially in the center of the lid 24. In some embodiments, the top side 30 of each push button tab 28 has an inner edge 36 attached to the disk 26 and an outer edge 38 opposite the inner edge 36 so that the tabs 28 can pivot along the inner edge 36 when a user presses downward on the top side 30 of the tab 28 (i.e., the inner edge 36 acts as a pivot axis). In some embodiments, the disk 26 includes a plurality of downwardly extending tabs 27 located about the perimeter of the disk 26, as best seen in FIG. 4. It has been observed that the tabs 28 should not be too flimsy and should resist movement in the vertical direction until the user pushes on the tabs 28 with a sufficient force to overcome the resistance. It has been observed that making the disk 26 a larger circumference is one way to achieved the required resistance.

Figure 2:
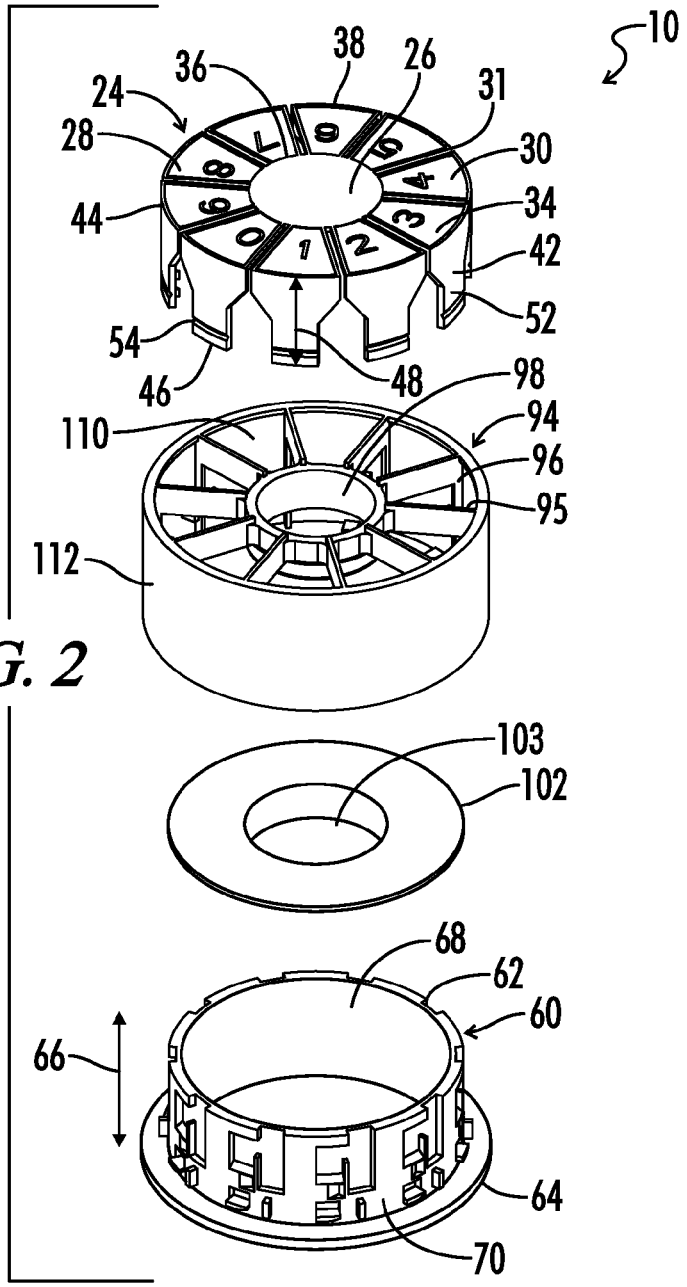
FIG. 2 illustrates an exploded, side, perspective view of the lock of FIG. 1.
Figure 14:
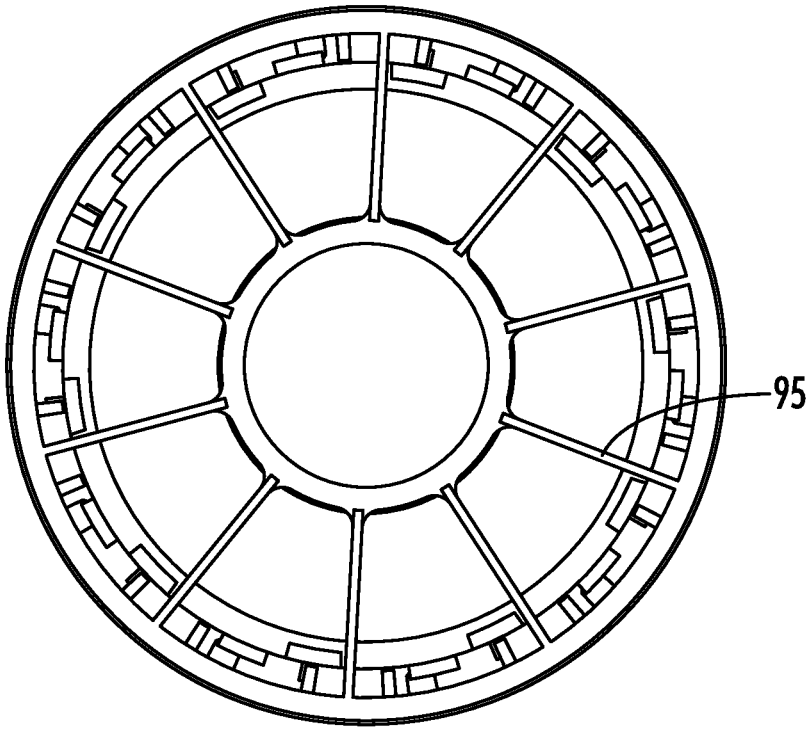
FIG. 14 is a bottom plan view of a lock of one embodiment of the present invention.

Each push button tab 28 includes a side tab 42 that extends downwardly from the top side 30 at approximately a 90 degree angle relative to the top side 30, as best seen in FIGS. 1 and 4. The side tab 42 has a top portion 44, a bottom portion 46, a side tab height 48 extending from the top portion 44 to the bottom portion 46, an interior surface 50 facing the container or other object 16, an exterior surface 52 opposite to the interior surface 50, and a scoring line (i.e., a tear line) 54 configured to allow a user to remove the bottom portion 46. The interior surface 50 of each side tab 42 includes a plurality of protrusions spaced along the side tab height 48. For example, in the illustrated embodiment, the interior surface 50 of each side tab 42 includes a top protrusion 58A, a middle protrusion 58B and a bottom protrusion 58C. Preferably, the bottom protrusion 58C is located in the removable bottom portion 46 so that the bottom protrusion 58C is removed when the bottom portion 46 is removed. Preferably, the side tabs 42 form a perimeter (e.g., a circular perimeter) and the side tabs 42 are spaced evenly about the perimeter, as best seen in FIGS. 2, 4 and 14. Preferably, the top protrusions 58A of all side tabs 42 are substantially equal in size, the middle protrusions 58B of all side tabs 42 are substantially equal in size, and the bottom protrusions 58C of all side tabs 42 are substantially equal in size. In some embodiments, all of the top, middle, and bottom protrusions 58A, 58B, and 58C are substantially equal in size. In some embodiments, each side tab 42 includes at least three protrusions 58A, 58B, and 58C spaced along the side tab height 48, and each protrusion 58A, 58B, and 58C includes a base 59A, 59B, and 59C attached to the side tab 42 and an apex 61A, 61B, and 61C extending from the base 59A, 59B, and 59C and each side tab 42 includes at least two apexes 59A, 59B, or 59C that point in opposite directions (e.g., one apex pointing to the left and two apexes pointing to the right or two apexes pointing to the left and one apex pointing to the right), a best seen in FIGS. 3 and 4. The reason for having the protrusion apexes 59A, 59B, and 59C point in opposite directions is that if all the protrusion apexes 59A, 59B, and 59C pointed to the right, for example, the user might be able to remove the lid 24 by turning the lid 24 to the left with a significant amount of force.

In some embodiments, the lock 10 further includes a receiver tube 60 that has a top 62, a bottom 64, a receiver tube height 66 extending from the top 62 to the bottom 64, an interior surface 68 facing the container or other object 16, an exterior surface 70 opposite the interior surface 68, and a substantially hollow interior 71. The receiver tube 60 is adapted to be placed on top 18 of the container or other object 16. The receiver tube 60 is not rotatable relative to the container or other object 16 but rather remains stationary as the lid 24 is rotated counterclockwise by a user. The exterior surface 70 of the receiver tube 60 includes a plurality of recesses, e.g., a top recess 72, a middle recess 73 and a bottom recess 75, spaced along the receiving tube height 66. The recesses 72, 73 and 75 are size and shaped to receive the protrusions 58A, 58B, and 58C. Preferably, the recesses 72, 73 and 75 are substantially equal in depth.

Figure 5:
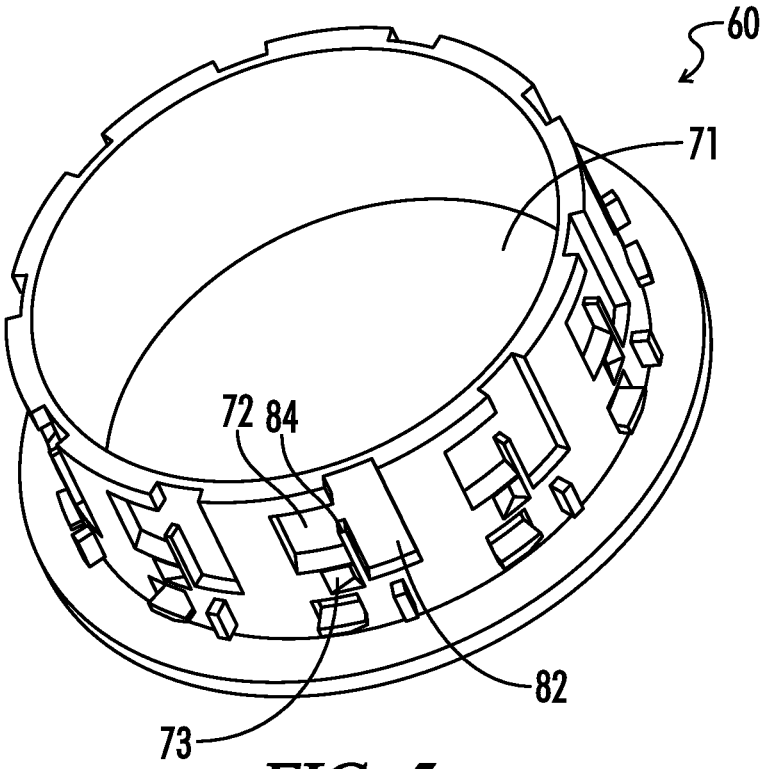
FIG. 5 illustrates a side, perspective view of a receiver tube of one embodiment of the present invention.
Figure 6:
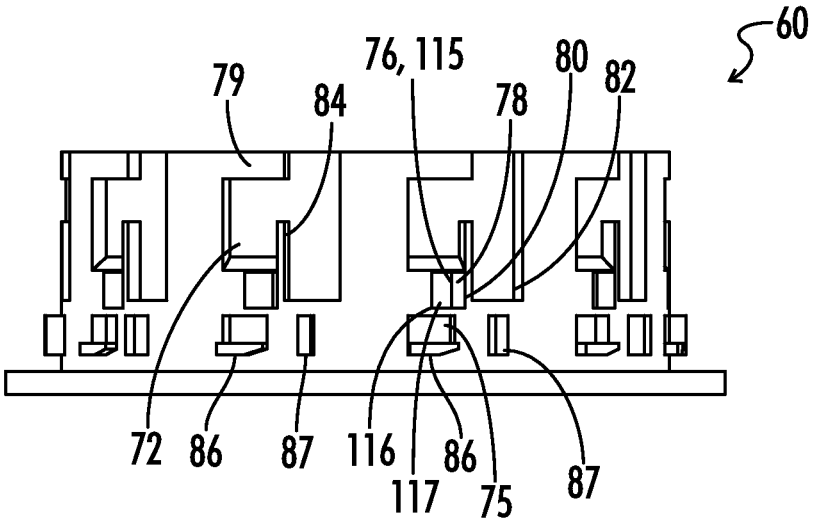
FIG. 6 illustrates a side, elevation view of the receiver tube of FIG. 5.
Figure 7A:
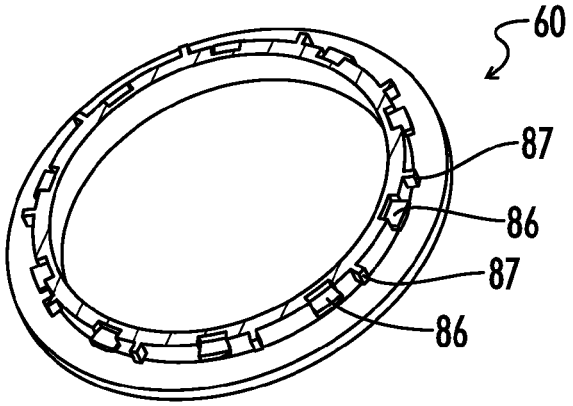
FIG. 7A illustrates a side, elevation view of the lower portion of a receiver tube of one embodiment of the present invention.
Figure 7B:
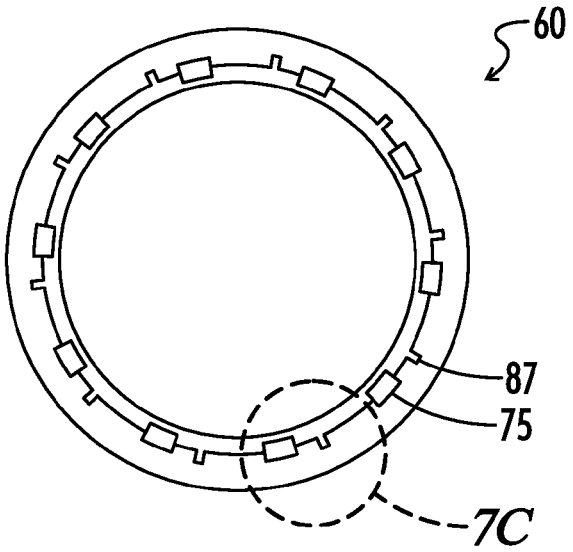
FIG. 7B illustrates a top, plan view of the lower portion of the receiver tube of FIG. 7A.
Figure 7C:
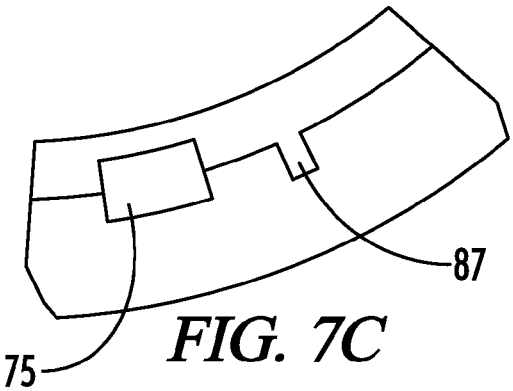
FIG. 7C illustrates a side, elevation view of the circled portion of the receiver tube of FIG. 7B.
Figure 7D:
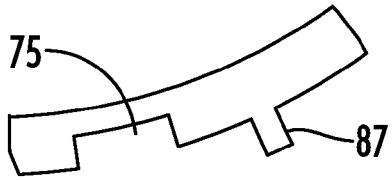
FIG. 7D illustrates a side, elevation view of the receiver tube of FIG. 7A with the very bottom of the receiver tube removed.
Figure 7E:
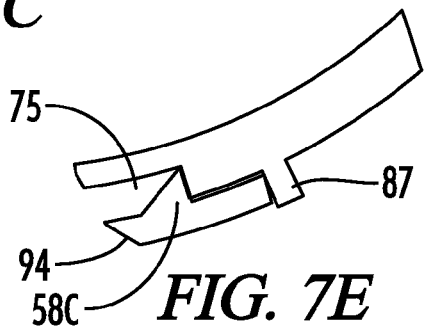
FIG. 7E illustrates a side, elevation view of the receiver tube of FIG. 7A with the very bottom of the receiver tube removed and a bottom protrusion of a side tab interacting with the receiver tube.
Figure 8A:
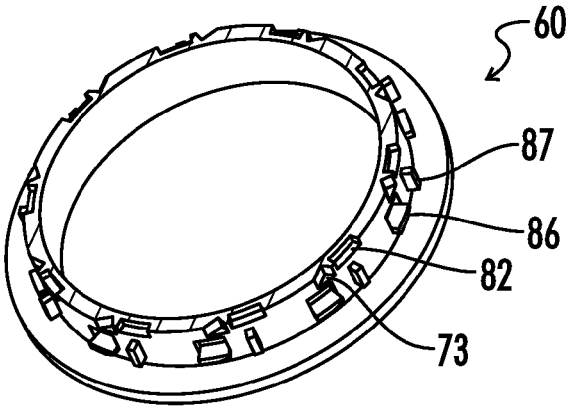
FIG. 8A illustrates a side, elevation view of the lower and middle portions of a receiver tube of one embodiment of the present invention.
Figure 8B:
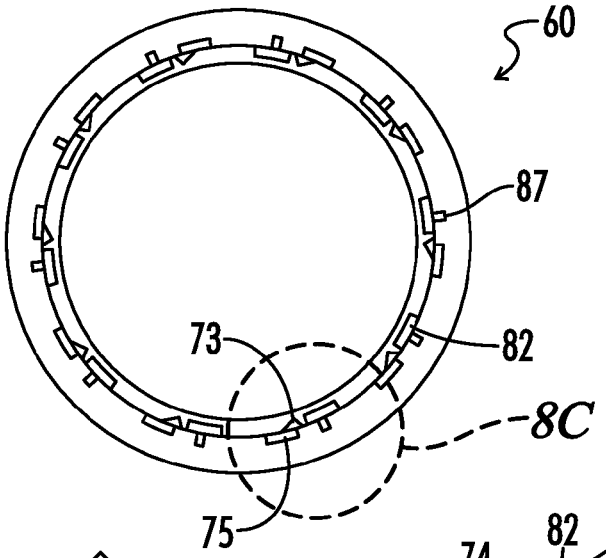
FIG. 8B illustrates a top, plan view of the lower and middle portions of the receiver tube of FIG. 8A.
Figure 8C:
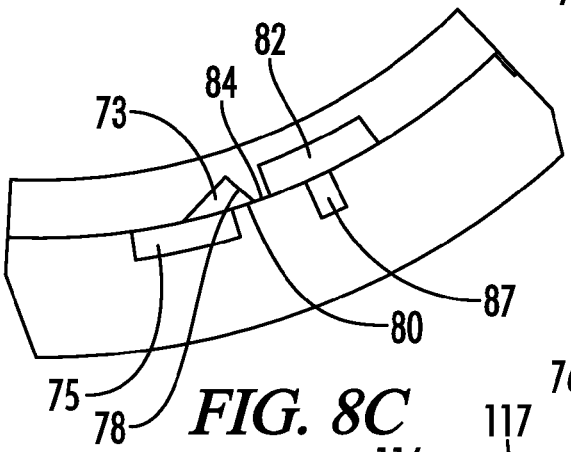
FIG. 8C illustrates a side, elevation view of the circled portion of the receiver tube of FIG. 8B.
Figure 8D:
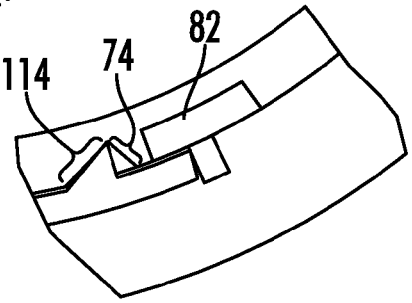
FIG. 8D illustrates a side, elevation view of the receiver tube of FIG. 8A.
Figure 8E:
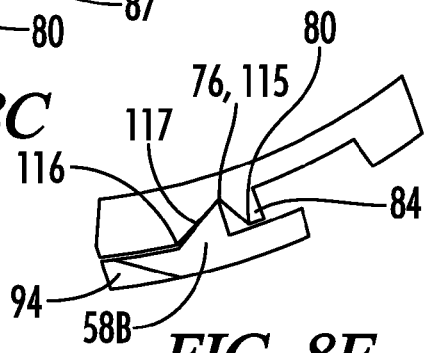
FIG. 8E illustrates a side, elevation view of the receiver tube of FIG. 8A with a middle protrusion of a side tab interacting with the receiver tube.
Figure 9A:
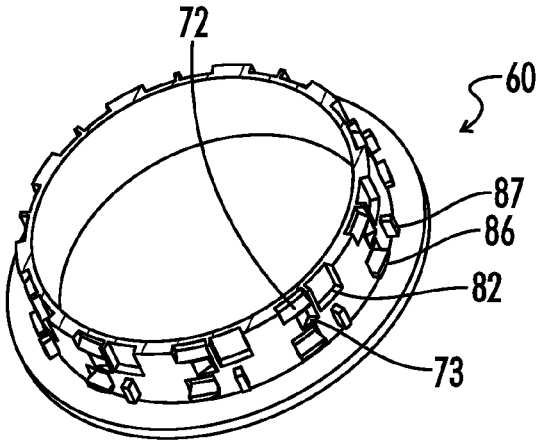
FIG. 9A illustrates a side, elevation view of the lower, middle and part of the top portion of a receiver tube of one embodiment of the present invention.
Figure 9B:
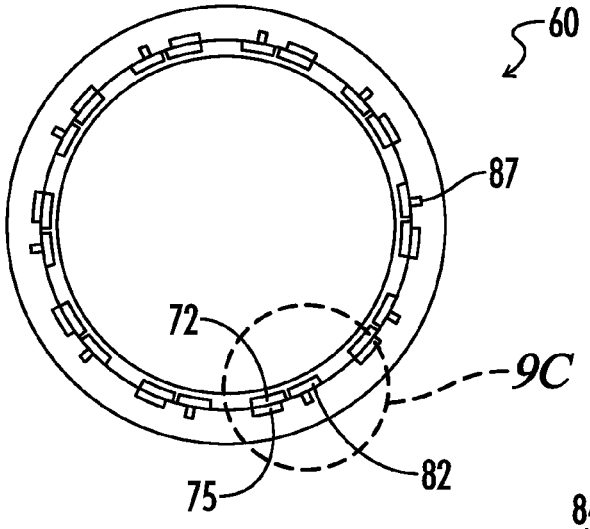
FIG. 9B illustrates a top, plan view of the lower, middle and part of the top portion of the receiver tube of FIG. 9A.
Figure 9D:
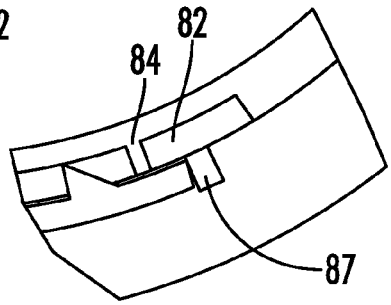
FIG. 9D illustrates a side, elevation view of the receiver tube of FIG. 9A.
Figure 9C:
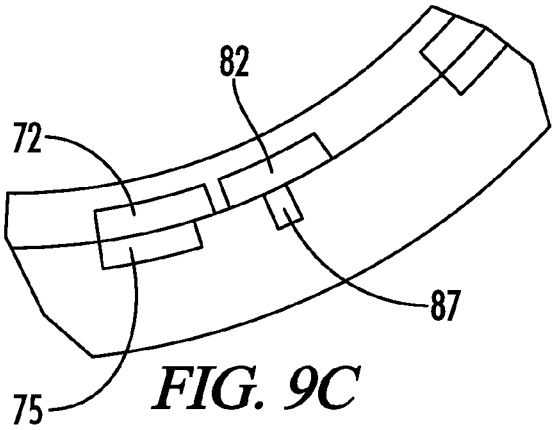
FIG. 9C illustrates a side, elevation view of the circled portion of the receiver tube of FIG. 9B.
Figure 9E:
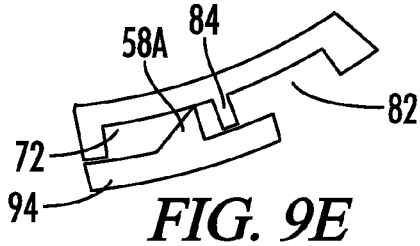
FIG. 9E illustrates a side, elevation view of the receiver tube of FIG. 9A with a top protrusion of a side tab interacting with the receiver tube.
Figure 10A:
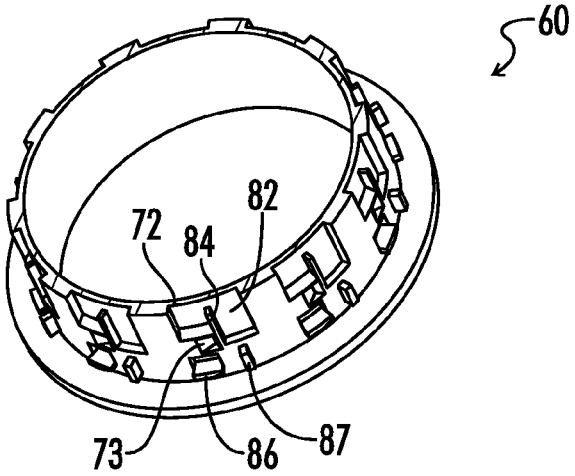
FIG. 10A illustrates a side, elevation view of a complete receiver tube of one embodiment of the present invention.
Figure 10B:
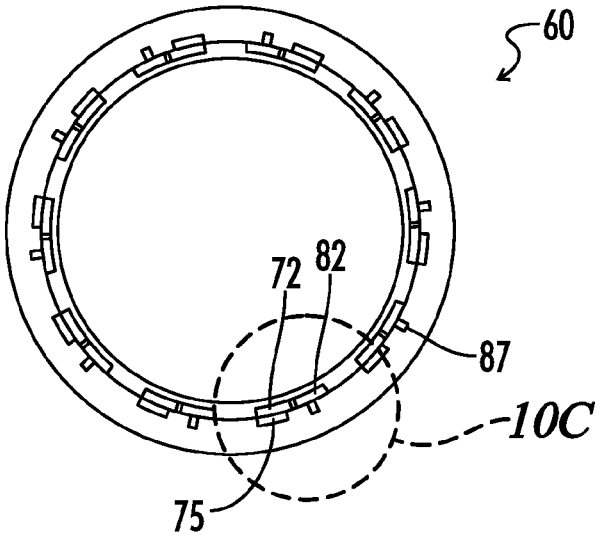
FIG. 10B illustrates a top, plan view of the receiver tube of FIG. 10A.
Figure 10C:
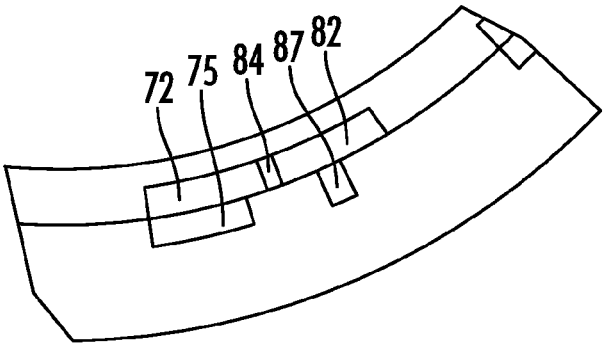
FIG. 10C illustrates a side, elevation view of the circled portion of the receiver tube of FIG. 10B.
Figure 10D:
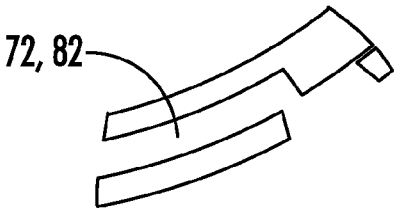
FIG. 10D illustrates a side, elevation view of the receiver tube of FIG. 10A.
Figure 10E:
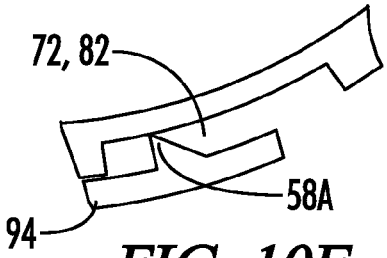
FIG. 10E illustrates a side, elevation view of the receiver tube of FIG. 10A with a top protrusion of a side tab interacting with the receiver tube.
Figure 11:
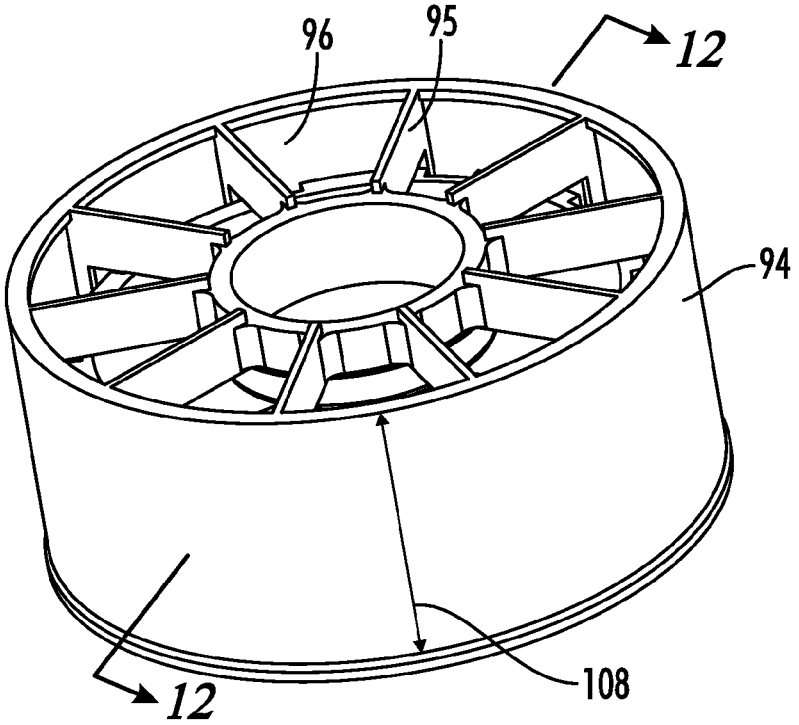
FIG. 11 is a side, perspective view of a rotatable tube and receiver tube.
Figure 12:
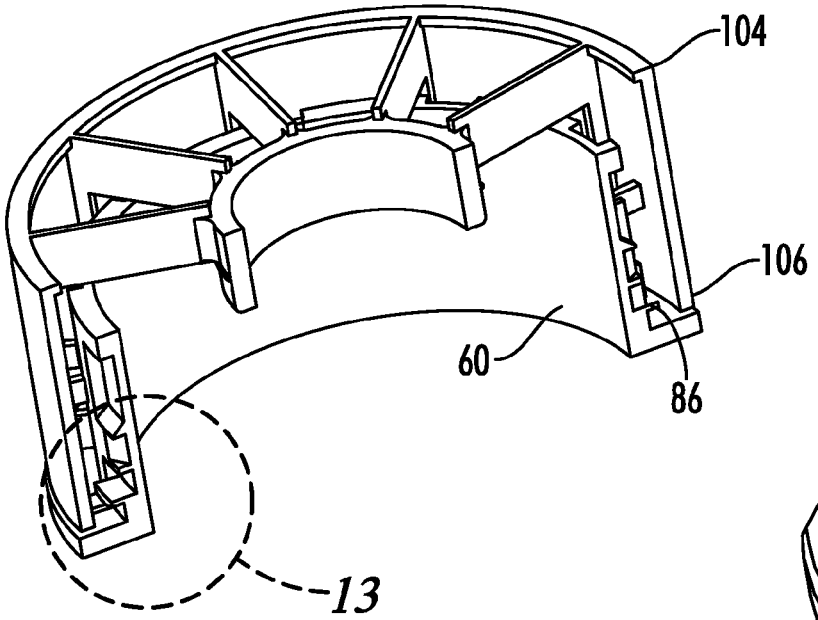
FIG. 12 is a sectional view of the rotatable tube of FIG. 11, taken along line 12-12 of FIG. 11.
Figure 13:
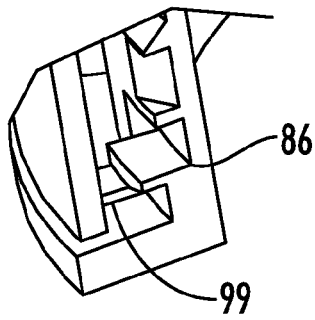
FIG. 13 is a close-up view of the circled portion of FIG. 11.

In some embodiments, at least one of the recesses 72, 73 or 75 of the receiver tube 60 (preferably the middle recess 73) includes two ramps. The first ramp 74 includes: 1) a low point 76; 2) a high point 80 that extends further from the container or other object 16 than the low point 76; and 3) a slope 78 between the high point 80 and the low point 76. In such embodiments, the receiver tube 60 further comprises a recess 82 adjacent to the first ramp 74 that is partially separated from the middle recess 73 by a wall 84, as best seen in FIGS. 5, 6 and 10A. The purpose of the first ramp 74 is that the first ramp 74 moves a protrusion of the side tab 42 (e.g., the middle protrusion 58B or bottom protrusion 58C) laterally when the protrusion moves along the first ramp 74 so that the protrusion enters a recess 82 adjacent to the middle recess 73 and first ramp 74. Preferably, the adjacent recess 82 extends from the top 62 of the receiver tube 60 downward so that there is no top wall between the adjacent recess 82 and the top 62 of the receiver tube 60. Preferably, the top of the top recess 72 is separated from the top 62 of the receiver tube 60 by a wall 79 so that the top protrusion 58A must be moved into the adjacent recess 72 for the lid 24 to be removed. The second ramp 114 is adjacent to the first ramp 74 and the second ramp 114 includes: 1) a low point 115; 2) a high point 116 that extends further from the container or other object 16 than the low point 115; and 3) a slope 117 between the high point 116 and the low point 115. In some embodiments, as best seen in FIGS. 6 and 8E, the low point 76 of the first ramp 74 is also the low point 115 of the second ramp 114. The purpose of the second ramp 114 is to allow the lock 10 to reset when the incorrect combination is entered. More particularly, as described below, to enter the combination, the tabs 28 forming the combination are depressed. The function of the second ramp 114 is so that the middle protrusion 58B moves laterally when it comes across the second ramp 114, which moves the tab 28 upwardly to the start position and the bottom protrusion 58C of the depressed tab 24 out of the bottom recess 75.

In some embodiments, the receiver tube 60 is generally cylindrical and has a plurality of first ramps 74 spaced about a circumference of the receiver tube 60. The receiver tube 60 preferably includes the same number of first ramps 74 as the number of push button tabs 28 and the first ramps 74 are spaced substantially evenly about the receiver tube 60. In some embodiments, the top recess 72 is located directly above the middle and bottom recess 73 and 75. Optionally, the receiver tube 60 further includes a ledge 86 located below each bottom recess 75 and a wall 87 adjacent to the ledges 86. In use, the receiver tube 60 remains on the container or other object 16 after the lid 24 is removed. However, it may be desirable to temporarily remove the receiver tube 60 from the container or other object 16 when, for example, for refilling a prescription of drugs contained within the container interior 12.

In some embodiments, the lock 10 does not include a receiver tube 60 but instead the top 18 of the container or other object 16 has the features of the receiver tube 60 described above, including, for example, the top, bottom, middle and adjacent recesses 72, 73, 75, and 82, the first and second ramps 74 and 114, the walls 79, 84, and 87 and the ledges 86.

The decision whether or not to include a receiver tube 60 may depend on, for example, if the lock 10 is used to retrofit an existing container or other object 16 (in which case, the receiver tube 60 may be desired) or if the lock 10 is used on a new container or other object 16 (in which case, the receiver tube 60 may be eliminated in favor of placing the above features on the top 18 of the container or other object 16 as described directly above to save on cost).

Figure 3:
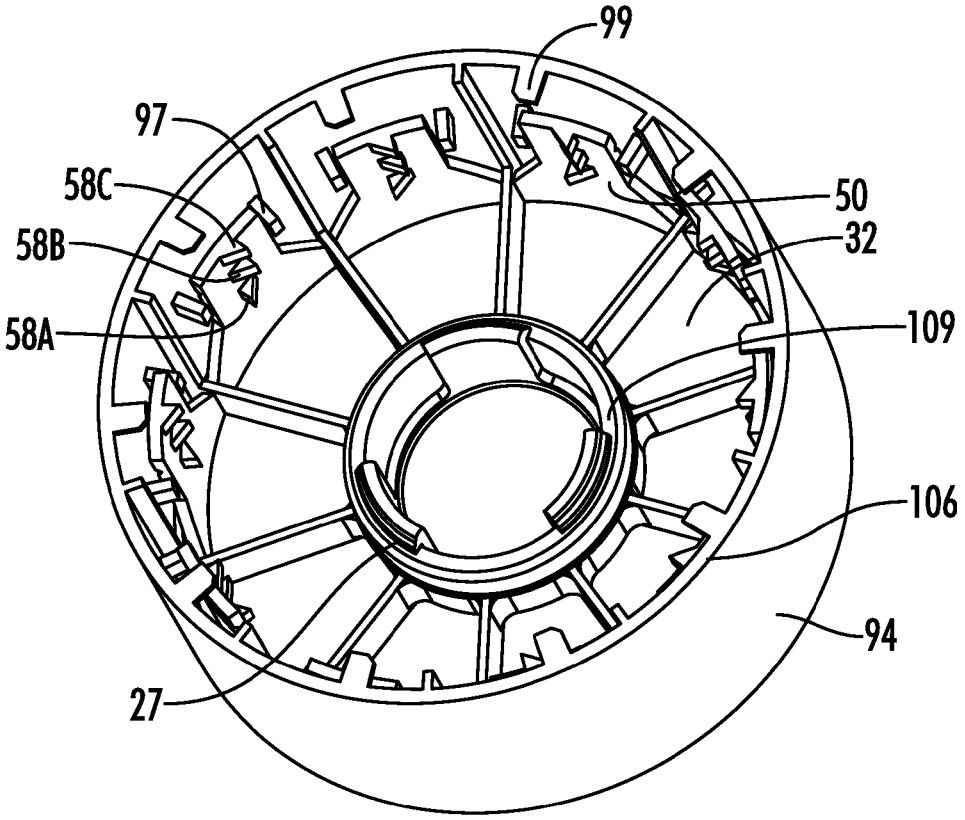
FIG. 3 illustrates a bottom, perspective view of a lid and rotatable tube of one embodiment of the present invention.

Regardless of whether the receiver tube 60 is used, the lock 10 may further include a rotatable tube 94 that has a top 104, a bottom 106, a height 108 extending from the top 104 to the bottom 106, an interior side 110 facing the container or other object 16 and an exterior side 112 opposite the interior side 110. The rotatable tube 94 may be placed directly over the receiver tube 60 or directly over the top 18 of the container or other object 16 (if the receiver tube 60 is not included) and the rotatable tube 94 is rotatable relative to the receiver tube 60 (if the receiver tube 60 is included) and the container or other object 16 (regardless of whether the receiver tube 60 is included, it being understood that even if the receiver tube 60 is included, the rotatable tube 94 will be rotatable relative to the container or other object 16). In some embodiments, the rotatable tube 94 is a wheel with a substantially hollow center 98 and a plurality of spokes 95. The disk 26 is placed over the substantially hollow center 98 and the downwardly extending tabs 27 extend from the disk 26 through the substantially hollow center 98, as best seen in FIG. 3. The apertures between the plurality of spokes 95 are adapted to receive the side tabs 42 from the lid 24. In some embodiments, the interior side 110 of the rotatable tube 94 includes a plurality of middle protrusions 97, located in substantially the center of the rotatable tube height 108 and distributed about the circumference of the rotatable tube 94. The distance between middle protrusions 97 is slightly longer than the width of the side tabs 42 so that the middle protrusions 97 hold the side tabs 42 in place as best seen in FIG. 3. The interior side 110 of the rotatable tube 94 also may include bottom protrusions 99 located at the bottom 106 of the rotatable tube 94 and distributed about the circumference of the rotatable tube 94. The bottom protrusions 99 are adapted to be placed below the ledges 86 located on the receiver tube 60 or the top of the container or other object 16 (if a receiver tube 60 is not included). The ledges 86 are configured to prevent the bottom protrusions 99 from moving vertically over the ledges 86 so a user cannot merely lift the rotatable tube 60 off of the container or other object 60 but rather has to turn the rotatable tube 94 and then lift the rotatable tube 94 to remove the lid or cap 24.

Preferably, the lid 24 is permanently attached to the rotatable tube 94 so that the push button tabs 28 do not fall out of the rotatable tube apertures 96 when the lid 24 is inverted (turned over). For example, in some embodiments, the downwardly extending disk tabs 27 have ledges 29 that lock to the bottom rim 109 of the rotatable tube central aperture 98, as best seen in FIGS. 3 and 4.

Optionally, the lock 10 further includes a gasket 102 located at the top 104 of (e.g., seated on) the rotatable tube 94 to create a seal between the lid 24 and the top 18 of the container or other object 16. If included, the gasket 102 includes a recess 103 to accommodate the downwardly extending disk tabs 27.

Operation of the lock 10 will now be described for illustrative purposes only.

Figure 15:
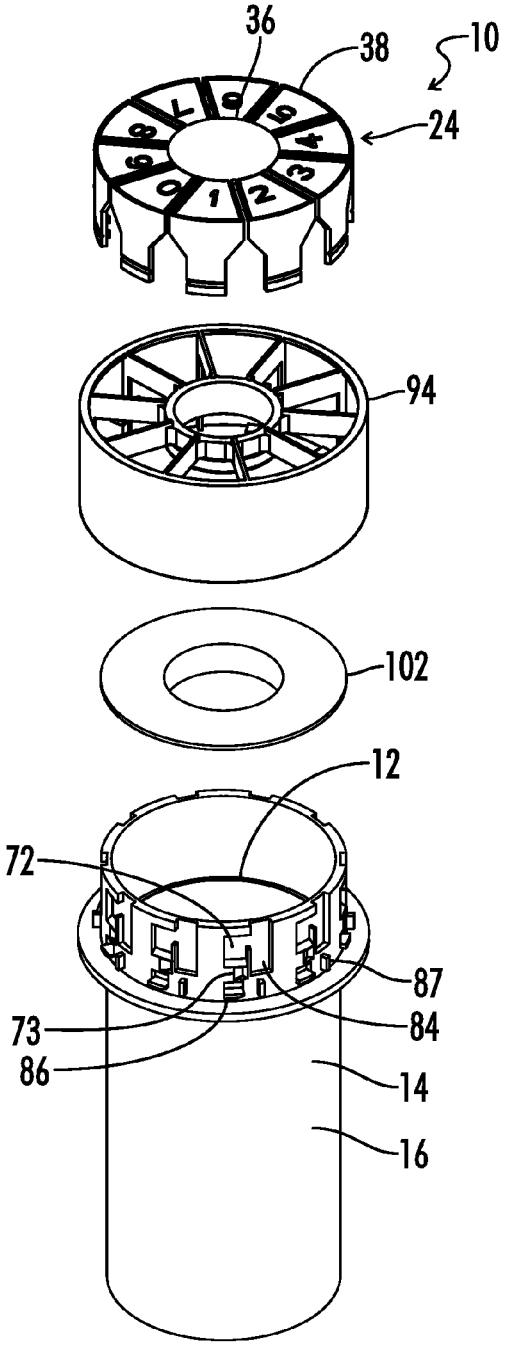
FIG. 15 is a side, exploded, perspective view of a lock and container of one embodiment of the present invention.
Figure 16:
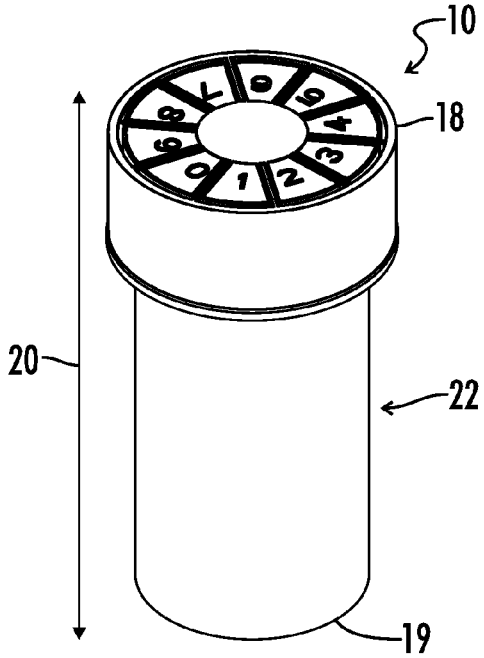
FIG. 16 is a side, perspective view of the lock and container of FIG. 14.

The combination 0-1-2 is chosen and the bottom portions 46 and the bottom protrusions 58C of the side tabs 42 attached to the top tabs 28 having the indicia 0, 1 and 2 are removed by tearing along the scoring line 54. The push button tabs 28 are inserted into the rotatable tube 94, and the rotatable tube 94 is placed on top 18 of the container 16 as shown in FIG. 15. The top protrusions 58A and middle protrusions 58B of all tabs 28 are located in the top recesses 72, and the bottom protrusions 58C of all tabs 28 except those attached to the tabs 28 having the indicia 0, 1 and 2 (which lack a bottom protrusion 58C) are located in the middle recess 73. The bottom protrusions 99 of the rotatable tube 94 are located directly below the ledges 86 so that the user cannot remove the lid 24 merely by lifting it vertically.

To remove the lid 24 from the container 16, the user depresses the push button tabs 28 having the numbers 0, 1 and 2. This causes the middle protrusions 58B of the tabs 28 having the indicia 0, 1 and 2 (i.e., the depressed tabs) to move into the middle recess 73. (Meanwhile, the top protrusions 58A and middle protrusions 58B of the non-depressed tabs 28 stay in the top recess 72 and the bottom protrusions 58C of the non-depressed tabs 28 stay in the middle recess 73). The user then turns the rotatable tube 94 counter-clockwise so that the top protrusions 58A of the tabs 28 having the indicia 0, 1 and 2 move into the adjacent recess 82 and the middle protrusions 58B of the tabs 28 having the indicia 0, 1 and 2 ride over the first ramps 74 and into the adjacent recesses 82. Meanwhile, the top protrusion and middle protrusions 58A and 58B of the non-depressed tabs 28 move into the adjacent recess 82 and the bottom protrusions 58C of the non-depressed tabs 28 also move into the adjacent recess 82, aided by the first ramps 74. The user moves the rotatable lid 24 upwardly and off of the container 16 to access the interior 12 of the container 16. During rotation of the rotatable tube 94, the tabs 28 stay depressed.

Access by a user entering the wrong combination will now be described. The combination 0-1-2 is chosen and the bottom portions 46 and the bottom protrusions 58C of the side tabs 42 attached to the top tabs 28 having the indicia 0, 1 and 2 is removed by tearing along the scoring line 54. The push button tabs 28 are inserted into the rotatable tube 94, and the rotatable tube 94 is placed on top 18 of the container 16 as shown in FIG. 15. The top protrusions 58A and middle protrusions 58B of all tabs 28 are located in the top recesses 72 and the bottom protrusions 58C of all tabs 28 except those attached to the tabs 28 having the indicia 0, 1 and 2 (which lack a bottom protrusion 58C) are located in the middle recesses 73. The bottom protrusions 99 of the rotatable tube 94 are located directly below the ledges 86 so that the user cannot remove the lid 24 merely by lifting it vertically.

The user enters the incorrect combination 3-4-5 and turns the rotatable tube 94 counter-clockwise However, in this case, the bottom protrusions 58C on the side tabs 42 attached to the push button tabs 28 having the indicia 3, 4 and 5 are not removed and the bottom protrusions 58C of these depressed tabs 28 become lodged in bottom recesses 75 (see FIG. 7E), preventing the protrusions of all tabs 28 from entering into the adjacent recess 82 and thereby preventing the user from removing the lid 24 from the container 16. In addition, the depressed tabs 28 contact the walls 87 adjacent to the ledges 86 when the user attempts to rotate the rotatable tube 94, adding an additional safeguard to prevent removal of the lid 24. (It will be appreciated that the depressed tabs 28 do not contact the walls 87 adjacent to the ledges 86 when the user rotates the rotatable tube 94 when the correct combination 0, 1, 2 is entered, because the bottom portions 46 of the tabs 28 having the indicia 0, 1 and 2 are removed. Thus, there is no impediment on these tabs 28 to contact the walls 87 adjacent to the ledges 86). To reset the lock 10, the user moves the rotatable tube 94 clockwise so that middle protrusion 58B of the tabs 28 having the indicia 3, 4 and 5 rides along the second ramp 114 and the second ramp 114 moves the middle protrusion 58B laterally, thereby raising the depressed tabs 28 (i.e., having the indicia 3, 4, and 5) to the start position.

Terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

Having now described the invention in accordance with the requirements of the patent statutes, those skilled in the art will understand how to make changes and modifications to the disclosed embodiments to meet their specific requirements or conditions. Changes and modifications may be made without departing from the scope and spirit of the invention.

What is claimed is:

1. A container lock comprising:

A) a container comprising a container interior, a container exterior, a container bottom and a container top;

B) a lock located at the container top, the lock configured to removably close the container top, the lock comprising:

i) a push button lid comprising a plurality of push button tabs, the push button tabs each having a) a top side, the top side comprising a top side interior surface facing the container top and a top side exterior surface opposite to the top side interior surface, the top side exterior surface comprising an indicia; and b) a side tab, the side tab extending downwardly from the top side at approximately a 90 degree angle relative to the top side, the side tab having a top portion, a bottom portion, a side tab height extending from the top portion to the bottom portion, a side tab interior surface facing the container and a side tab exterior surface opposite the side tab interior surface, the side tab having a scoring line configured to allow a user to remove the bottom portion, the side tab interior surface comprising a plurality of protrusions, the plurality of protrusions spaced along the side tab height; and ii) a receiver tube, the receiver tube comprising a receiver tube top, a receiver tube bottom, a receiver tube height extending from the receiver tube top to the receiver tube bottom, a receiver tube interior surface facing the container, a receiver tube exterior surface opposite the receiver tube interior surface, and a substantially hollow interior, the receiver tube exterior surface comprising a plurality of recesses spaced along the receiver tube height and configured to receive the protrusions.

2. The container lock of claim 1, wherein at least one of the recesses of the receiver tube comprises a ramp, further wherein the receiver tube comprises a recess adjacent to the ramp and further wherein the ramp is configured to move a protrusion of the plurality of protrusions laterally when the protrusion moves along the ramp.

3. The container lock of claim 2, wherein a wall partially separates the ramp from the recess adjacent to the ramp.

4. The container lock of claim 2, wherein the recess adjacent to the ramp extends from the receiver tube top downward.

5. The container lock of claim 2, wherein the receiver tube further comprises a top recess located directly above the ramp.

6. The container lock of claim 2, wherein the receiver tube comprises a plurality of ramps disposed about a circumference of the receiver tube.

7. The container lock of claim 6, wherein the ramps are spaced substantially evenly apart about the circumference.

8. The container lock of claim 1, wherein the receiver tube is generally cylindrical, and wherein the plurality of recesses are spaced about a circumference of the receiver tube in addition to being spaced along the receiver tube height.

9. The container lock of claim 1, wherein each side tab comprises at least three protrusions spaced along the side tab height and each protrusion comprises a base attached to the side tab and an apex extending away from the base, and further wherein each side tab comprises at least two apexes that point in opposite directions.

10. The container lock of claim 1, wherein the push button lid further comprises a disk located substantially in the center of the push button lid and further wherein the top sides of the push button tabs of the push button lid are connected to the disk.

11. The container lock of claim 10, wherein each of the plurality of the push button tabs comprises an inner edge attached to the disk, and an outer edge opposite the inner edge.

12. The container lock of claim 11, wherein the push button tabs are configured to pivot along the inner edge.

13. The container lock of claim 1, wherein the side tabs of the push button tabs form a perimeter.

14. The container lock of claim 13, wherein the side tabs of the push button tabs are spaced evenly about the perimeter.

15. The container lock of claim 1, wherein each of the plurality of push button tabs are substantially the same size and shape.

16. The container lock of claim 1, wherein the indicia are numbers.

17. The container lock of claim 1, wherein the indicia on each push button tab is different.

18. The container lock of claim 1 further comprising a rotatable tube, the rotatable tube having a plurality of tab apertures, each tab aperture configured to receive a side tab.

19. The container lock of claim 18, wherein the rotatable tube substantially surrounds said receiver tube.

20. The container lock of claim 1, wherein the receiver tube is not rotatable relative to the container.

21. A container lock comprising:

A) a container comprising a container interior, a container exterior, a container bottom, a container top, a container height extending from the container bottom to the container top, and a plurality of recesses spaced along the container height;

B) a lock located at the container top, the lock configured to removably close the container top, the lock comprising:

i) a generally circular push button lid configured to rotate about the container top and comprising a plurality of push button tabs, the push button tabs each having a) a top side, the top side comprising a top side interior surface facing the container top and a top side exterior surface opposite to the top side interior surface, the top side exterior surface comprising an indicia; and b) a side tab, the side tab extending downwardly from the top side at approximately a 90 degree angle relative to the top side, the side tab having a top portion, a bottom portion, a side tab height extending from the top portion to the bottom portion, a side tab interior surface facing the container and a side tab exterior surface opposite the side tab interior surface, the side tab having a scoring line configured to allow a user to remove the bottom portion, the side tab interior surface comprising a plurality of protrusions, the plurality of protrusions spaced along the side tab height, wherein the plurality of recesses are configured to receive the protrusions.

22. The container lock of claim 21, wherein at least one of the recesses comprises a ramp, further wherein the container top comprises a recess adjacent to the ramp and further wherein the ramp is configured to move a protrusion of the plurality of protrusions laterally when the protrusion moves along the ramp.

23. The container lock of claim 22, wherein a wall partially separates the ramp from the recess adjacent to the ramp.

24. The container lock of claim 22, wherein the recess adjacent to the ramp extends from the container top downward.

25. The container lock of claim 22, wherein the container top further comprises a top recess located directly above the ramp.

26. The container lock of claim 22, wherein the container top comprises a plurality of ramps spaced substantially evenly about a circumference of the container top.

27. The container lock of claim 21, wherein the plurality of recesses are spaced about a circumference of the container top in addition to being spaced along the container height.

28. The container lock of claim 21, wherein each side tab comprises at least three protrusions spaced along the side tab height and each protrusion comprises a base attached to the side tab and an apex extending away from the base, and further wherein each side tab comprises at least two apexes that point in opposite directions.

29. The container lock of claim 21, wherein the generally circular push button lid further comprises a disk located substantially in the center of the push button lid and further wherein the top sides of the push button tabs of the push button lid are connected to the disk.

30. The container lock of claim 29, wherein each of the plurality of the push button tabs comprises an inner edge attached to the disk, and an outer edge opposite the inner edge and further wherein the push button tabs are configured to pivot along the inner edge.

* * * * *